US006955585B2

(12) United States Patent
Mitsuishi et al.

(10) Patent No.: US 6,955,585 B2
(45) Date of Patent: Oct. 18, 2005

(54) CURVED SURFACE MACHINING METHOD AND AN APPARATUS THEREOF

(75) Inventors: Mamoru Mitsuishi, 1-2-2-905 Ojima, Koto-ku, Tokyo-to (JP); Shinichi Warisawa, 3-3-5-D Nakanobu, Shinagawa-ku, Tokyo-to (JP); Kouichi Kuramoto, Okayama (JP); Takayuki Inoue, Okayama (JP)

(73) Assignees: Nakashima Propeller Co., Ltd., Okayama (JP); Mamoru Mitsuishi, Tokyo (JP); Shinichi Warisawa, Tokyo (JP)

( * ) Notice: Subject to any disclaimer, the term of this patent is extended or adjusted under 35 U.S.C. 154(b) by 0 days.

(21) Appl. No.: 10/934,293

(22) Filed: Sep. 3, 2004

(65) Prior Publication Data

US 2005/0095955 A1 May 5, 2005

(30) Foreign Application Priority Data

Sep. 5, 2003 (JP) ..... 2003-313768
Jul. 30, 2004 (JP) ..... 2004-223430

(51) Int. Cl.[7] ..... B24C 1/08

(52) U.S. Cl. ..... 451/5; 451/36; 451/40; 451/42; 901/41

(58) Field of Search ..... 451/5, 36–42, 451/60, 104, 113; 83/53, 117; 901/41

(56) References Cited

U.S. PATENT DOCUMENTS 5,048,238 A * 9/1991 Ikeda ..... 451/36
5,573,446 A * 11/1996 Dey et al. ..... 451/39
5,591,068 A * 1/1997 Taylor ..... 451/104
6,612,906 B2 * 9/2003 Benderly ..... 451/29
6,688,953 B2 * 2/2004 Kawasaki et al. ..... 451/327
6,719,611 B2 * 4/2004 Kordonski et al. ..... 451/36

* cited by examiner

*Primary Examiner*—Lee D. Wilson
*Assistant Examiner*—Anthony Ojini
(74) *Attorney, Agent, or Firm*—Koda & Androlia

(57) ABSTRACT

A curved surface machining method that performs finishing of the surface of a workpiece into a curved surface. The method includes the steps of: setting a workpiece in a rotating or stationary state in a water tank filled with an abrasive-containing solution into which an abrasive with a grain size of less than 1 $\mu$m has been admixed; and spraying a high-speed fluid in the abrasive-containing solution while a position, direction, and angle thereof is controlled relative to the workpiece, thus grinding and finishing the surface of the workpiece to an intended surface roughness and profile accuracy.

7 Claims, 5 Drawing Sheets

CURVED SURFACE MACHINING METHOD AND AN APPARATUS THEREOF

BACKGROUND OF THE INVENTION

1. Technical Field

The present invention relates to a curved surface machining method and a curved surface machining apparatus, wherein a high-speed fluid is sprayed onto a workpiece in an abrasive-containing solution into which an abrasive has been admixed, and the surface of the workpiece is ground to an intended surface roughness and profile accuracy.

2. Description of the Related Art

In structural components requiring long-term durability such as artificial joints, for example, the profile accuracy and surface roughness of opposing sliding surfaces have a marked effect on the abrasion resistance of these surfaces. In conventional practice, manual procedures that use a V-type grindstone, a toroid grindstone, or a spherical grindstone have been used in curved surface machining for these spherical surfaces or non-spherical surfaces. However, finishing a desired curved surface requires a great deal of skill and has not been something that anyone can easily accomplish. Furthermore, time is required to finish the surface, and mass production has not been deemed feasible.

Machining a curved surface such as a sliding surface in an artificial joint requires not only accurately finishing the surface to the necessary profile accuracy, but also performing smooth finishing to an extremely low surface roughness. One method of curved surface machining involves mixing an abrasive into a high-speed fluid and spraying the resulting material onto a machined surface, as seen in Japanese Patent Application Laid-Open (Kokai) No. 2000-158344, but this approach has problems in that the abrasive causes wear and clogging in the nozzle for spraying the high-speed fluid. Furthermore, a large amount of the abrasive is needed, and the abrasive sometimes scatters into the surroundings.

Therefore, a method is proposed in which a workpiece is set in an abrasive-containing solution into which an abrasive has been admixed, and a water jet is sprayed in this solution, so that the abrasive in the mixture is sprayed onto the workpiece, as disclosed in Japanese Patent Application Laid-Open (Kokai) No. 2002-113663.

While this method has advantages in that a small amount of the abrasive is sufficient and the abrasive does not scatter into the air because the abrasive can be used cyclically in the mixture, an object of the machining in this prior-art example is foreign matter removal such as deburring and deposit removal. Consequently, precise machining aimed at improving the surface roughness or dimensional accuracy of a curved surface cannot be accomplished. Above all, the method in the prior-art example described above causes additional damage on the surface of the workpiece because an abrasive with a grain size of 1 $\mu$m or more is used, which is unacceptable even in terms of surface roughness alone.

A machining apparatus for performing such machining is described in the above-mentioned prior-art example. However, from the standpoint of the machining purpose (i.e., performing deburring or deposit removal) as well, this apparatus is provided only with a rough control mechanism. It has probably been assumed that translational three-dimensional control of the nozzle for spraying the high-speed fluid would suffice, and that, at most, adding rocking or horizontal rotation of the nozzle would be adequate. However, such a control function is insufficient for improving the surface roughness or profile accuracy of a curved surface.

BRIEF SUMMARY OF THE INVENTION

The object of the present invention is to solve such problems as described above and is made based on the discovery that a curved surface of a workpiece can be finished as desired by a process in which a high-speed fluid (water jet) is sprayed onto the workpiece in an abrasive-containing solution into which a specific abrasive has been admixed, while the fluid is controlled in a variety of ways.

The above object is accomplished by unique steps of the present invention for a curved surface machining method that performs finishing of the surface of a workpiece into a curved surface; and in the present invention, the method includes the steps of: setting a workpiece in a rotating or stationary state in a water tank filled with an abrasive-containing solution into which an abrasive with a grain size of less than 1 $\mu$m has been admixed; and spraying a high-speed fluid in the abrasive-containing solution while a position, direction, and angle thereof is controlled relative to the workpiece, thus grinding and finishing the surface of the workpiece to an intended surface roughness and profile accuracy.

In the above curved surface machining method: the workpiece is a spherical body attached to an axially rotating spindle that is set in the horizontal direction and oriented in the direction of Y axis; a nozzle for spraying the high-speed fluid is oriented in the direction of Z axis, is disposed in the upper portion at a specific standoff distance away from the equator line of the workpiece, and is directed along the tangential line in the Z-axis direction of the external peripheral surface of the workpiece; and a table on which the water tank is provided is adapted to move in an arc in the XY-plane so that the center of the nozzle is maintained in a position on the tangential line; and wherein the high-speed fluid is ejected from the nozzle to grind the external peripheral surface of the workpiece by the abrasive in the abrasive-containing solution; and the advance speed of the table is controlled so that the amount of jet flow received by the sprayed surface of the workpiece per unit of time remains the same.

Furthermore, in the above curved surface machining method: the concentration of the abrasive in the abrasive-containing solution decreases as the high-speed fluid is sprayed; and the concentration of the abrasive-containing solution is corrected in addition to a control of advance speed of the table so that the amount of abrasive in the jet flow received by the sprayed surface of the workpiece per unit of time remains the same during grinding.

In addition, makeup abrasive is added to the abrasive-containing solution; the makeup amount, an amount of water going in the water tank, and an increased amount of water due to the jet flow are measured; and the estimated value of the amount of abrasives is calculated based on the passage of time from the start of machining, and the estimated value is used as the basis for correcting the concentration.

Furthermore, the above object is accomplished by a unique structure of the present invention for a curved surface machining apparatus that carries out the above-described curved surface machining method, and in the present invention, the curved surface machining apparatus includes: a water tank that is mounted on a table whose position is controlled in longitudinal (X-axis) and transverse (Y-axis) directions and that is filled with an abrasive-containing solution into which an abrasive has been admixed; a workpiece-holding device for holding a workpiece by a transversely disposed spindle in the abrasive-containing solution; and a high-speed fluid spraying device for spraying a high-speed fluid onto the workpiece from a nozzle plunged into the abrasive-containing solution and positionally controlled in the vertical (Z-axis) direction.

When a high-speed fluid into which an abrasive has been admixed is sprayed onto the surface of a workpiece, an extremely delicate grinding finish can be achieved even with spherical surface machining by reducing the grain size of the abrasive to 1 $\mu$m or less and by adjusting the relative position, direction, and angle of the nozzle and the workpiece. As a result, not only can the surface roughness be improved, but a profile accuracy (circularity) can also be improved.

The present curved surface machining method naturally has such advantages of water jet machining in an abrasive-containing solution that there is no need to supply an abrasive because the abrasive in the abrasive-containing solution is circulated by the high-speed fluid; there is no resulting abrasion or clogging of the nozzle; the running costs are low, so that an economical improvement is achieved; there is no need to stir the solution in order to make the abrasive uniform because the abrasive-containing solution is circulated by the high-speed fluid; and the abrasive and the like can be prevented from scattering since the high-speed fluid is sprayed in a liquid, making it possible to avoid contaminating the surrounding environment.

Incidentally, special considerations need to be taken for the present machining method when the workpiece is a sphere such as in the head of a bone in an artificial hip joint. More specifically, a water jet is sprayed onto the entire external peripheral surface of the workpiece while rotating the workpiece and varying the relative position of the nozzle and the workpiece. However, the workpiece has different peripheral velocities near the equator and near the poles, and advancing the nozzle or the workpiece at a constant velocity makes the machining amount different, so that the circularity drops. In concrete terms, the machining amount per unit length increases near the poles of a workpiece with a low peripheral velocity, which results in a distorted spherical shape. Accordingly, the advance speed of the table is controlled so that the amount of the sprayed water jet received by the machined surface of the workpiece per unit of time remains constant.

The same principle applies to the abrasive. In other words, the concentration of the abrasive in the abrasive-containing solution decreases with time due to the jet flow of the high-speed fluid. Accordingly, the machining amount decreases with the passage of time if the advance speed alone is controlled as described above, resulting in reduced circularity. In view of this, the concentration of the abrasive is corrected, and this action is additionally taken into account in the advance speed of the table. More specifically, the advance speed of the table is further controlled so that the amount of the abrasive in the jet flow received by the machined surface of the workpiece per unit of time remains constant. There are various methods for correcting the concentration, but the method adopted entails suitably supplementing abrasive-containing solution (abrasive), measuring this makeup amount, the amount of water in the water tank, and the increased amount of water due to the jet flow, calculating the estimated value of the amount of abrasive after some time has elapsed following the start of machining, and using this calculated value as the basis for correcting the concentration.

Furthermore, according to the curved surface machining apparatus of the present invention, the water tank, the workpiece holding device, and the high-pressure jet flow spraying device are controlled along three and five axes, making it possible to increase the surface roughness and profile accuracy even of a complex curved surface. Particularly, if the spindle of the workpiece holding device is controlled in terms of its axial rotation and vertical angle, then machining of a more complex curved surface becomes possible.

DETAILED DESCRIPTION OF THE INVENTION

Figure 1:
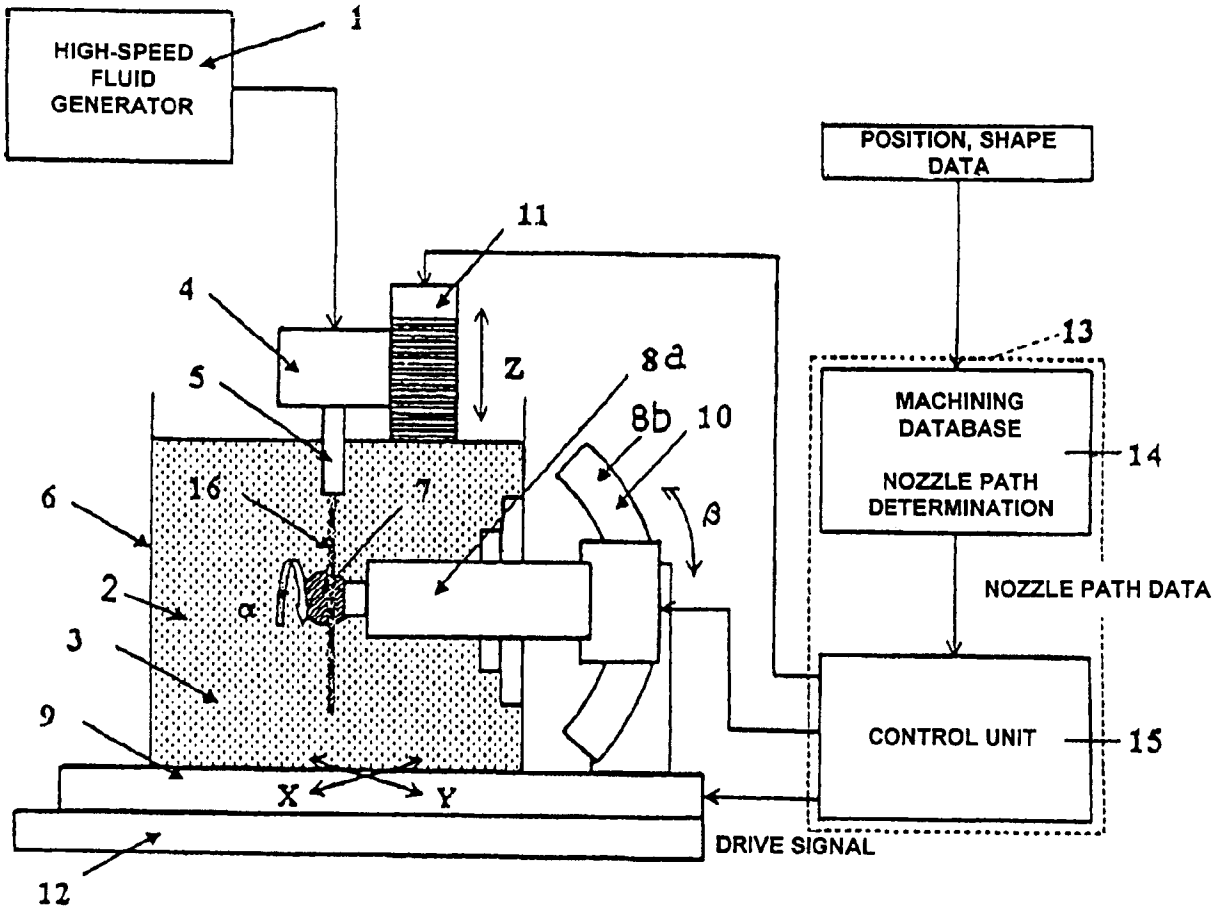
FIG. 1 is an explanatory diagram of a curved surface machining apparatus according to the present invention.

FIG. 1 is an explanatory diagram of the curved surface machining apparatus according to one example of the present invention.

A table 9 whose position is controlled in the longitudinal (X-axis) and transverse (Y-axis) directions is disposed on a base 12, and a water tank 6 that is filled with an abrasive-containing solution 2 consisting of an abrasive 3 added to water is mounted on the table 9. One or more materials such as metal, sand, ceramics, and resin are used as this abrasive 3, and the particle size of any of these is adjusted to less than 1 $\mu$m (one $\mu$m). Furthermore, an oily substance is sometimes used for the medium instead of water.

A spindle 8*a* capable of holding a workpiece 7 at its tip end is plunged in the water tank 6, and this spindle 8*a* is controlled in terms of its angle of axial rotation ($\alpha$ axis) and the vertical angle ($\beta$ axis) formed when the base section thereof moves on a guide 8*b* that extends concentrically about the workpiece 7 in a vertical plane. A workpiece holding device 10 is thus configured.

Furthermore, a vertically oriented nozzle 5 is provided above the water tank 6 so that the position thereof can be controlled in the vertical direction (Z axis) with respect to a column 11, and the tip end of this nozzle 5 is plunged into the abrasive-containing solution 2. The nozzle 5 in this case is an abrasive nozzle, and another nozzle with a smaller diameter is provided to the upstream side of the nozzle 5 (not shown). Moreover, the nozzle 5 is linked by a pipe to a high-speed fluid generator 1 for generating a high-speed fluid 16, and these components constitute a high-speed fluid spraying device 4. Furthermore, the high-speed fluid spraying device 4 and the table 9 (water tank 6) are independent from each other, and their respective positions are controlled separately. Furthermore, though not shown in the drawings, the base section of the spindle 8*a* may be designed so that the horizontal angle thereof can be adjusted to allow the spindle to move in the horizontal direction about the workpiece 7.

The elements described above are driven (controlled) by a control device 13. This control device 13 has a calculation unit 14 and a control unit (output section) 15, the results calculated by the calculation unit 14 are output to the control unit 15, and a command is sent from the control unit 15 to the drive mechanisms of the respective axes. A servomotor, a ball screw, a linear motor, and a rail are suited for the drive mechanisms of the respective axes, and it is preferable to perform the commands with an NC since this enables control with a high degree of precision.

Figure 2:
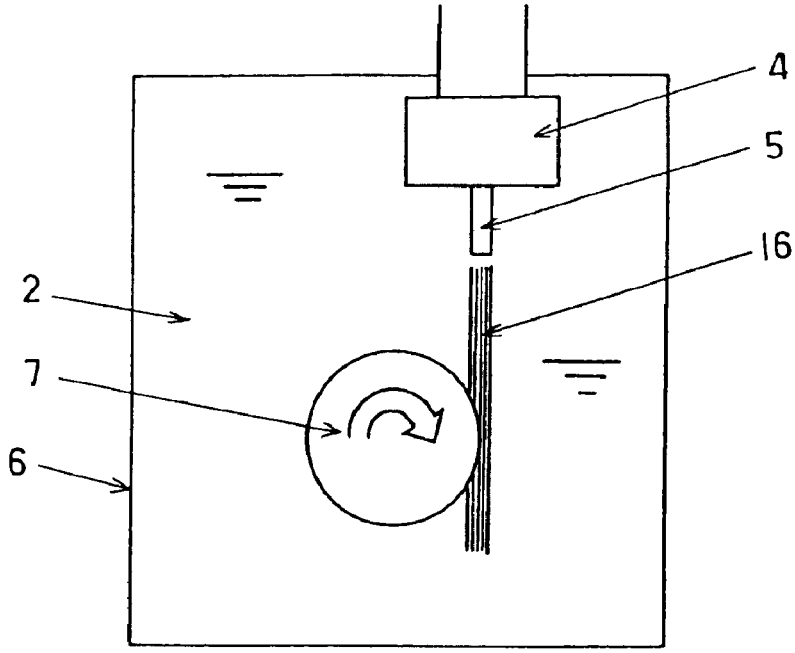
FIG. 2 is an explanatory diagram of the mutual relationship between the nozzle and the workpiece during smooth machining in the present invention.
Figure 3:
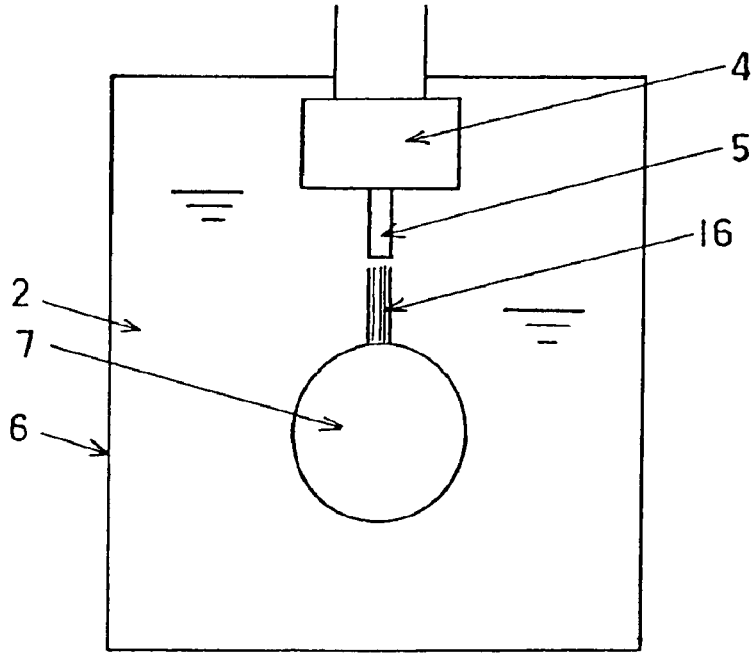
FIG. 3 is an explanatory diagram of the mutual relationship between the nozzle and the workpiece during carving machining in the present invention.

When the high-speed fluid into which an abrasive has been admixed is sprayed onto the workpiece, if the high-speed fluid is sprayed onto the surface of the workpiece from the tangential direction (FIG. 2), then this surface is primarily machined to be smooth. On the other hand, if the fluid is sprayed in the normal direction (FIG. 3), then this surface is machined by carving out a concavity. In this process, the workpiece is constantly rotated in the direction of a axis during machining in some cases or is kept stationary in other cases. The workpiece is rotated when the object is to uniformly grind (machine) the external periphery, in which case the workpiece is preferably rotated in the direction in which the high-speed fluid is sprayed (the spraying speed of the high-speed fluid is higher than the peripheral velocity of the workpiece). When the object is to partially carve out the surface, the workpiece is kept stationary at the necessary angle.

If the rotation of the workpiece is stopped and a small carving is machined into the surface, a fine localized concavity is formed in the portion on which the high-speed fluid is sprayed, which results in excellent frictional properties. The above-described smooth machining and carving machining are combined in the actual machining to create the curved surface intended in the surface of a workpiece. Incidentally, this process is strictly a finishing process, so that a rough finish is preferably performed in advance. The machining time is shortened as the rough finish in this case approaches the finished shape.

In this case, the high-speed fluid is sprayed into the water in the water tank into which the abrasive has been admixed, so that the abrasive in the water tank is consumed by machining, and the concentration thereof decreases. This change in abrasive concentration in the water tank is inconsequential in brief machining, but the abrasive concentration in the water tank must be managed when machining extends over a long period of time. Therefore, a mechanism for supplying and expelling the abrasive-containing solution in the water tank is provided.

The calculation unit converts the surface shape of the workpiece obtained from measurement or design data into input data, and calculates and determines the movement path of the nozzle from this shape data on the basis of the accumulated machining data. If the relationship between the machining conditions and the type of machining is retained in advance in the calculation unit as a database on the basis of past machining data, an appropriate nozzle path is determined according to the intended curved surface shape.

The nozzle path data calculated by the calculation unit is transferred to the control unit, and is then transferred from the control unit to each drive mechanism to enact control. Performing these drive controls while spraying the high-speed fluid makes continuous automatic machining of workpieces possible.

Furthermore, after the machining directed by the calculation unit is complete, it is also possible for the calculation unit to further specify a separate type of machining while the workpiece is set. In this case, a database having information concerning machining conditions and the type of machining is utilized, and the type of machining can be varied merely by varying the nozzle path. A plurality of types of machining can thereby be simultaneously performed with a single arrangement. In this case, the type of media in the water tank, the concentration, and the grain size may be varied according to the type of machining.

Meanwhile, because the nozzle path is determined using the shape measurement data or CAD data, the present invention can be applied flexibly not only to the machining of sliding surfaces in artificial joints, but also to the machining of curved surfaces in various structural components.

Embodiment 1

Test results will be shown for a case in which the curved surface machining apparatus according to the present invention was used to actually perform finishing machining for improving the surface roughness and profile accuracy of the surface of a workpiece with a convex spherical surface. An abrasive dissolved in water was used as the abrasive-containing solution used herein, the head of a bone (22.2 mm in diameter (surface roughness: 0.04 $\mu$m Ra)) for a spherical artificial hip joint made of a medical Co—Cr—Mo alloy was used as the workpiece, and a water jet was used as the high-speed fluid.

Figure 4:
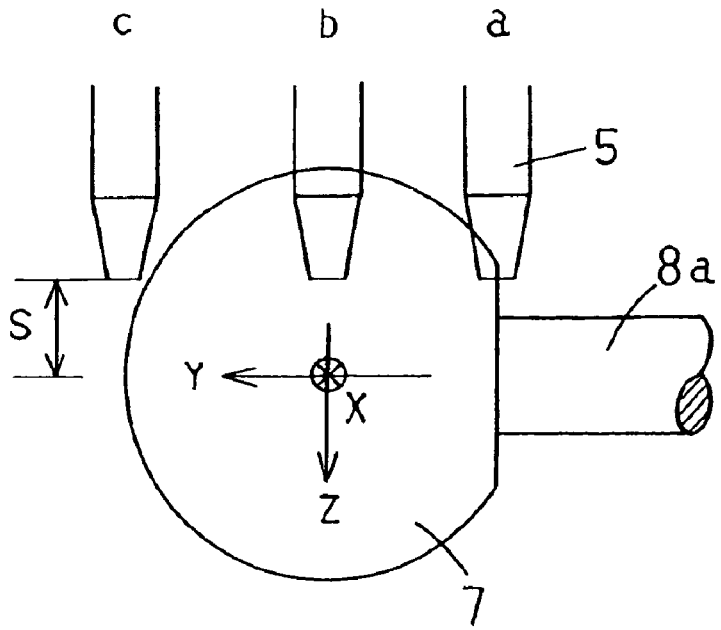
FIG. 4 is a side view of the head of a bone mounted on the spindle in the curved surface machining apparatus of the present invention.
Figure 5:
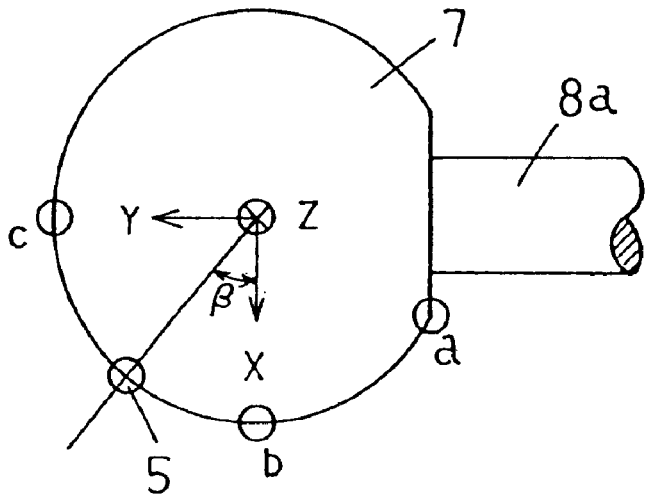
FIG. 5 is a plan view of the head of a bone mounted on the spindle in the curved surface machining apparatus of the present invention.

The procedure for this test is as follows:

First, the head of a bone is set on an attachment jig and mounted on a spindle, and the center of the spherical surface formed by the head of the bone is determined. FIG. 4 is an explanatory diagram showing this step as seen from the X-axis direction, and FIG. 5 is an explanatory diagram as seen from the Z-axis direction. The spindle is provided in the horizontal Y-axis direction, and the nozzle 5 is oriented in the Z-axis direction. In this case, the center of the nozzle is disposed along the tangential line of the Z-axis direction in the external periphery of the head of the bone, but the tip end is disposed at a standoff distance S above the equator line (cross-sectional line in the XZ plane) of the head of the bone.

This standoff distance is provided also for the purpose of avoiding interference between the nozzle and the workpiece. Increasing this distance expands the water jet, decreases the fluid speed, and softens machining. Decreasing this distance conversely intensifies the machining. Consequently, widely varying the standoff distance according to the properties of the workpiece and the like makes it possible to select the optimum types of machining.

Next, the water tank is filled with a sufficient amount of water to submerge the head of the bone, and a specific amount of abrasive is admixed. The shape data for the head of the bone is then input to the calculation unit, and a water jet is sprayed from the nozzle upon determining the type of machining, while the drive mechanisms of the X axis and Y axis are driven so that the tip end of the nozzle moves in relative fashion in the order a→b→c at an advance speed of 0.03 mm. The act of driving the table and moving the nozzle relative to a specified position of the workpiece is referred to herein as "advancing of the nozzle," and the corresponding speed is referred to as the "advance speed."

The conditions used in this case are shown in Table 1.

TABLE 1

| | |
|---|---|
| Nozzle diameter (mm) | 0.25 |
| Abrasive grain size ($\mu$m) | 0.25 to 3 |
| Initial abrasive concentration (wt %) | 1.2 |
| Standoff distance (mm) | 10 |
| Water jet pressure (Mpa) | 200 |
| Rotational speed of workpiece (rpm) | 3000 |
| Abrasive material | Green silicon carbide |

The results of the machining described above are shown in Table 2 as a relationship with the grain size of the abrasive. In the table, "incidence direction of water jet" is defined as the angle at which the water jet is incident on the surface of the workpiece, and "machining result" is defined as the surface roughness on the surface of the workpiece following machining.

TABLE 2

| Abrasive Grain Size ($\mu$m) | Incidence Direction of Water Jet | Machining Result ($\mu$m Ra) |
|---|---|---|
| 3 | Tangential direction | 0.035 |
| 0.6 | Tangential direction | 0.014 |
| 0.5 | Tangential direction | 0.015 |
| 0.6 | Normal direction | Localized concavity |

As is clear from the above results, when the abrasive grain size is large (3 $\mu$m), a satisfactory surface with a surface roughness (0.02 $\mu$m Ra or less) required for the sliding surfaces of artificial joints cannot be obtained because the machining resolution is too rough. Conversely, it was concluded that an abrasive grain size of less than 1 $\mu$m (one $\mu$m) is desirable because a satisfactory surface can be obtained with an abrasive grain size of less than 1 $\mu$m.

The above results include a case in which the incidence angle of the water jet is set in the normal direction in relation to the surface of the head of the bone in addition to a case in which this angle is set in the tangential direction. It was possible to confirm that a localized concavity had been formed in the surface when the angle was set in the normal direction. Thus, if the relationship between each parameter and the type of machining is stored as a machining database, and if the intended type of machining is specified prior to machining, it is possible to determine with the aid of the calculation unit the nozzle path whereby this type of machining is realized.

Furthermore, since it is possible to control the type of machining merely by controllably driving the position and orientation of the workpiece and nozzle tip end on the basis of the machining database, it goes without saying that a surface can be finished, for example, after a localized concavity is formed without changing the arrangement of the workpiece. It is also possible to control the type of machining, for example, by giving consideration to the standoff distance or the discharge conditions of the water jet.

Depending on the workpiece material and the type of machining, furthermore, other fluids and other media may be used in addition to water and the abrasive as the abrasive-containing solution. Moreover, the high-speed fluid is not limited to a water jet, and may also be another liquid, gas, or another suitable fluid.

Embodiment 2

Next, a method for optimally machining a spherical workpiece such as the head of a bone will be described.

If the workpiece is spherical, the peripheral velocity of a certain peripheral surface along the Y axis is different depending on the distance (angle) from the equator of the sphere. Therefore, rotating the workpiece at a constant rotational speed or keeping the advance speed of the nozzle constant causes the machining conditions to differ in that portion, so that circularity is sometimes reduced even more. Furthermore, the amount of abrasive in the abrasive-containing solution decreases as the grinding progresses, so the conditions are different at the start and end of machining. Accordingly, machining conditions must be set with this taken into account.

Figure 6:
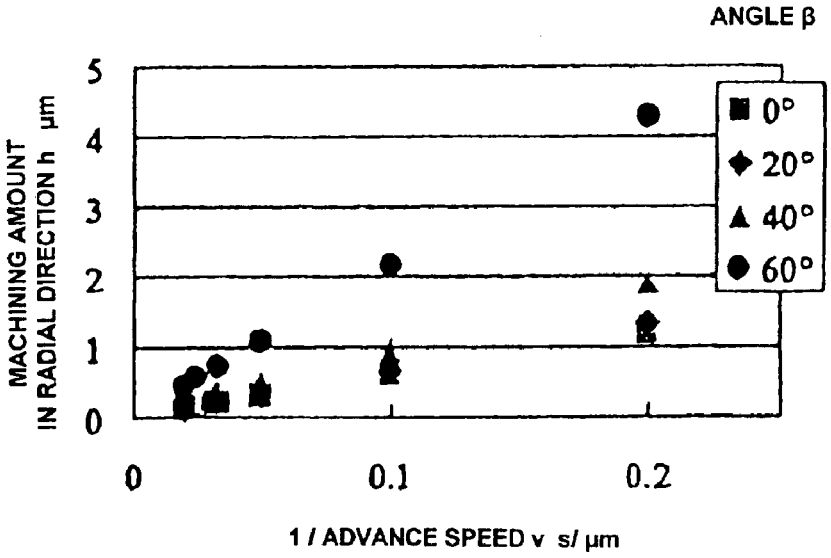
FIG. 6 shows the characteristics of the machining amount and the nozzle advance speed in the present invention.

First, in the case of the advance speed, the amount of the water jet received by the machined surface of the workpiece (the sprayed surface being sprayed with the water jet) per unit of time is designed to remain essentially constant. More specifically, it is designed so that the advance speed is in an inversely proportional relationship with the peripheral velocity. FIG. 6 shows the characteristics of the machining amount and the reciprocal number of the advance speed, with the angle β (see FIG. 5) formed by the center of the head of the bone and the location of the nozzle taken as a parameter, and it is clear from FIG. 6 as well that the advance speed of the nozzle and the machining amount have an inverse relationship.

Therefore, using a proportionality constant $k_v$ (β), the relationship between the advance speed v (β) at angle β and the machined depth h (β) can be expressed as:

$$h(\beta)=1/v(\beta)\cdot k_v(\beta) \quad (1)$$

In view of this, the advance speed of the nozzle is determined using Formula (1). More specifically, the proportionality constant $k_v$ (β) in Formula (1) is calculated by a simulation; and using this proportionality constant, the advance speed v (β) at which the intended machining amount $h_d$ (β) in the radial direction is achieved is determined by the following formula:

$$v(\beta)=k_v(\beta)\cdot 1/h_d(\beta) \quad (2)$$

Figure 7:
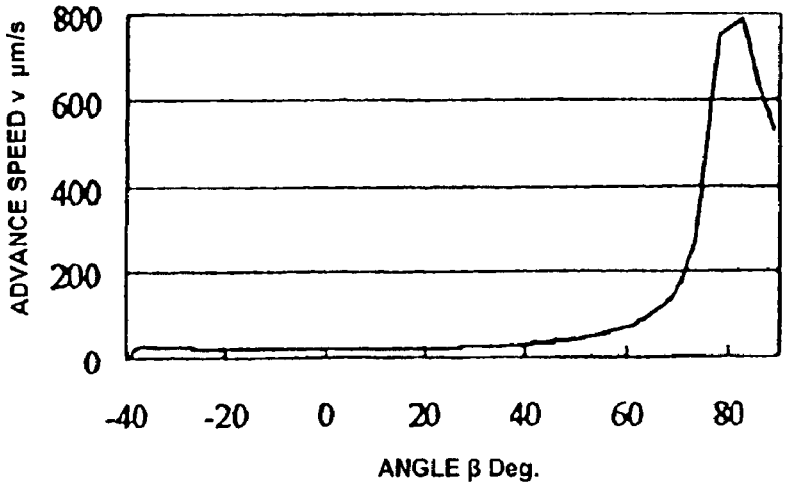
FIG. 7 shows the characteristics of the advance speed and the angle of the head of a bone in the present invention.

FIG. 7 shows the advance speed of the nozzle when the intended value for the machining amount in the radial direction is 0.3 $\mu$m; and from which it is seen that the advance speed must increase when the angle β exceeds 30° and must rapidly increase when the angle β nears 70°.

The foregoing is achieved by controlling the advance speed but may also be accomplished by the control of the rotational speed in which the rotational speed of the spindle is controlled according to the location of the nozzle in the same manner. Furthermore, both of these controls may be used together. The conditions for these controls should be such that the amount of the water jet received by the machined surface of the workpiece per unit of time remains the same, and any type of control may be used as long as this condition is achieved.

Incidentally, the controls described above are based on the condition that the concentration of the abrasive is constant. In actuality, however, the concentration of the abrasive decreases as machining is performed. Therefore, the concentration must be corrected, and this principle is also aimed at making sure that the amount of the abrasive in the water jet received by the machined surface of the workpiece per unit of time remains the same. More specifically, the amount by which the concentration changes is corrected with respect to the advance speed determined by Formula (2).

Figure 8:
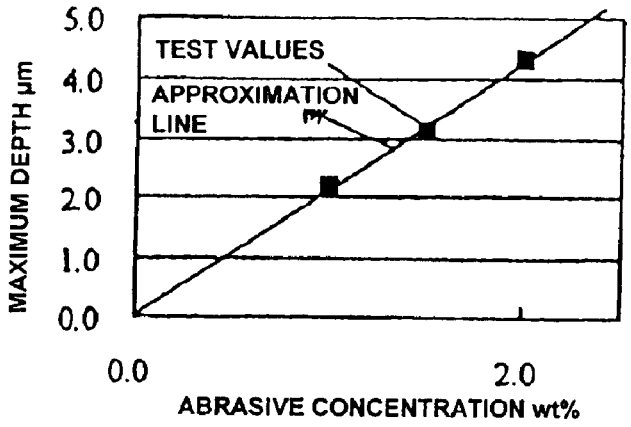
FIG. 8 shows the characteristics of the machined depth and the abrasive concentration in the present invention.

FIG. 8 shows the characteristics in which the relationship between the concentration of the abrasive (abrasive grains) and the machined depth is determined by experimentation, and it can be seen from FIG. 8 as well that the two are in a proportional relationship. Therefore, the concentration correction value $k_d \cdot d$ ($k_d$: proportionality constant (0.667), d: concentration) should be multiplied by the advance speed determined by Formula (2). For this reason, the concentration of the abrasive during machining needs to be measured with a densitometer, but in actuality accurate measurement is difficult. In view of this, the amount of water going in the water tank, the amount of added abrasive, and the increased amount of water per unit of time due to the water jet are measured, an estimated value of the abrasive concentration is calculated based on the passage of time from the start of machining, and this estimated value is used as the basis for correcting the concentration.

Embodiment 3

In order to verify the above, with the use of the machining conditions shown in Table 3, an experimentation and simulation were carried out with the method shown below. The circularity of the head of the bone following machining was then measured or the following three cases:

(i) When the advance speed was kept constant at 0.01 mm/s (ii) When the advance speed was controlled (iii) When the advance speed was controlled and the concentration corrected

TABLE 3

| | |
|---|---|
| Nozzle advance speed (mm/s) | 0.01 |
| Nozzle diameter (mm) | 0.25 |
| Abrasive grain size ($\mu$m) | 1.0 |
| Initial abrasive concentration (wt %) | 3.2 |
| Standoff distance (mm) | 8.5 |
| Water jet pressure (Mpa) | 200 |
| Rotational speed of workpiece (rpm) | 3000 |
| Abrasive material | Green silicon carbide |

Figure 9:
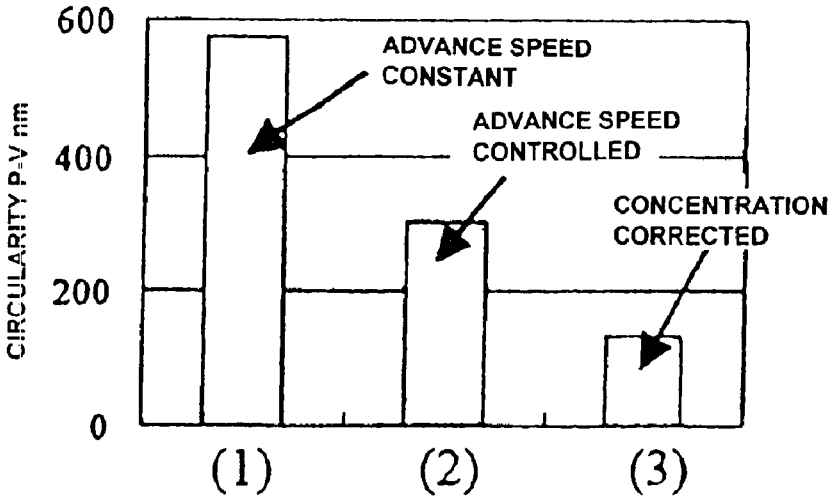
FIG. 9 shows the characteristics of the control methods and circularity in the present invention.

FIG. 9 shows the results of measuring the circularity shown in the results of (i) through (iii). In the case of (i) above, machining was excessive near the poles of the head of a bone where the advance speed is low, so that the circularity deteriorated even further from the initial 300 nm to 576 nm. In the case of (ii) above, advance speed control was applied; here, the circularity was restored to 304 nm, and it was confirmed that his type of control had some effect. Nevertheless, it was revealed that the radius increased near the poles, which is believed to be due to a reduction in the concentration of the abrasive. In view of this, in the case of (iii) above in which concentration correction was added, the circularity was improved to 136 nm, and the shape was also closer to a perfect circle. This is believed to be because the decrease in the machining amount resulting from the decrease in abrasive concentration can be supplemented, and a uniform machining amount is obtained across the entire peripheral surface of the head of a bone.

The present invention is as described above, but of course, the present invention is not limited to the sliding surfaces of artificial joints and is also applicable to curved surface machining of metal molds, structural components having free surfaces, and the like. Needless to say, the present invention is not limited to curved surfaces but can be applied to the machining of plane surfaces.

What is claimed is:

1. A method for machining a curved surface that finishes a surface of a workpiece into a curved surface, comprising the steps of:

setting a workpiece in a rotating or stationary state in a water tank filled with an abrasive-containing solution into which an abrasive with a grain size of less than 1 $\mu$m has been admixed, and spraying a high-speed fluid in said abrasive-containing solution while a position, direction, and angle thereof is controlled relative to said workpiece, thus grinding and finishing a surface of said workpiece to an intended surface roughness and profile accuracy.

2. The method for machining a curved surface according to claim 1, wherein said workpiece is a spherical body attached to an axially rotating spindle that is set in a horizontal direction and oriented in a direction of Y axis;

a nozzle for spraying said high-speed fluid is oriented in a direction of Z axis, is disposed in an upper portion at a specific standoff distance away from an equator line of said workpiece, and is directed along a tangential line in a Z-axis direction of an external peripheral surface of said workpiece;

a table on which said water tank is provided is adapted to move in an arc in an XY-plane so that a center of said nozzle is maintained in a position on said tangential line; and wherein said high-speed fluid is ejected from said nozzle to grind said external peripheral surface of said workpiece by said abrasive in said abrasive-containing solution; and an advance speed of said table is controlled so that an amount of jet flow received by a sprayed surface of said workpiece per unit of time remains the same.

3. The method for machining a curved surface according to claim 2, wherein concentration of said abrasive in said abrasive-containing solution decreases as said high-speed fluid is sprayed; and concentration of said abrasive-containing solution is corrected in addition to a control of advance speed of said table so that the amount of abrasive in said jet flow received by said sprayed surface of said workpiece per unit of time remains the same during grinding.

4. The method for machining a curved surface according to claim 3, wherein makeup abrasive is added to said abrasive-containing solution; and said makeup amount, an amount of water going in said water tank, and an increased amount of water due to said jet flow are measured; and an estimated value of the amount of abrasives is calculated based on a passage of time from the start of machining, and said estimated value is used as a basis for correcting said concentration.

5. An apparatus for machining a curved surface that carries out the method for machining a curved surface of claim 1, said curved surface machining apparatus comprising:

a water tank that is mounted on a table whose position is controlled in longitudinal (X-axis) and transverse (Y-axis) directions and that is filled with an abrasive-containing solution into which an abrasive has been admixed;

a workpiece-holding device for holding a workpiece by a transversely disposed spindle in said abrasive-containing solution; and a high-speed fluid spraying device for spraying a high-speed fluid onto said workpiece from a nozzle plunged into said abrasive-containing solution and positionally controlled in a vertical (Z-axis) direction.

6. The apparatus for machining a curved surface according to claim 5, wherein said spindle is controlled in terms of an angle about an axis thereof ($\alpha$ axis) and an angle in a vertical direction ($\beta$-axis).

7. The apparatus for machining a curved surface according to claim 5 or 6, wherein said water tank, workpiece-holding device, and high-speed fluid spraying device are controlled by a control device; and said control device is controlled using data that corresponds to a intended curved surface from among various types of stored machining data.

* * * * *